United States Patent [19]

Jackson et al.

[11] 4,369,732

[45] Jan. 25, 1983

[54] IMAGING APPARATUS ADAPTED FOR DEVELOPING INTERMITTENTLY MOVING WEBS

[75] Inventors: David R. Jackson, Rochester; Allen J. Rushing, Webster, both of N.Y.

[73] Assignee: Eastman Kodak Company, Rochester, N.Y.

[21] Appl. No.: 239,221

[22] Filed: Feb. 27, 1981

[51] Int. Cl.[3] ..... G03D 3/10; G03G 15/10

[52] U.S. Cl. ..... 118/681; 118/660; 254/317; 355/10; 355/16

[58] Field of Search ..... 355/10, 16; 118/660, 118/681; 354/88, 317

[56] References Cited

U.S. PATENT DOCUMENTS 3,416,493 12/1968 Robinson et al. ..... 118/637

3,743,407 7/1973 Smith ..... 355/10

4,017,174 4/1977 Cheeseman ..... 355/10

*Primary Examiner*—Evan K. Lawrence

*Attorney, Agent, or Firm*—John D. Husser

[57] ABSTRACT

Imaging apparatus of the kind in which successive image portions of a length of strip material are sequentially imaged and developed, features a development device adapted to provide continuous development periods of equal duration for all image portions, regardless of intermittent operation of said apparatus. One disclosed embodiment features guide means sequentially movable at the strip-feed rate between a first position, constraining all strip portions that are within the development zone in a developing relation, and a second position wherein all such strip portions are released from the developing relation.

6 Claims, 3 Drawing Figures

FIG. 1
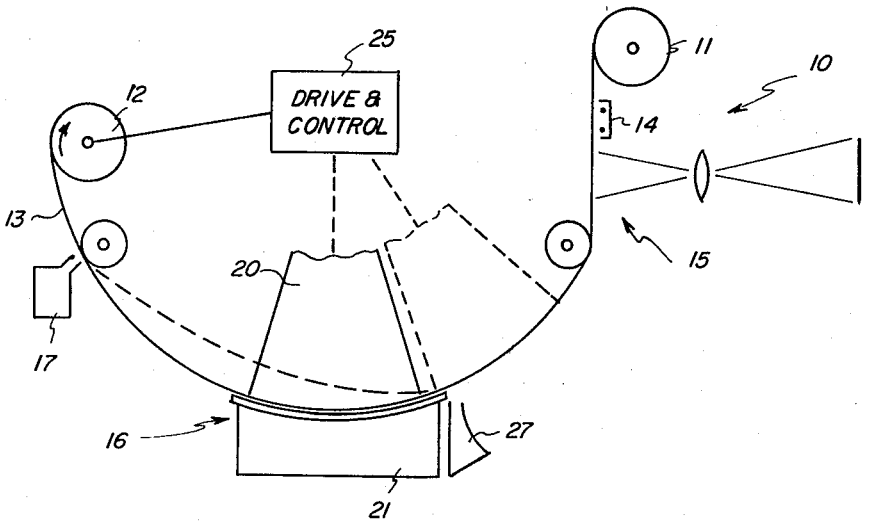
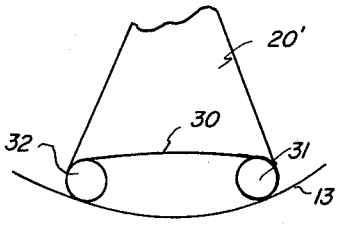
FIG. 2
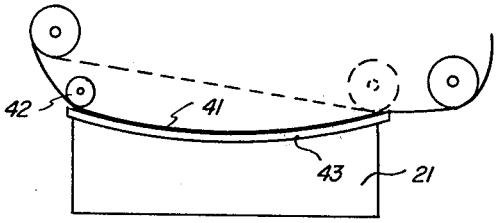
FIG. 3

IMAGING APPARATUS ADAPTED FOR DEVELOPING INTERMITTENTLY MOVING WEBS

BACKGROUND OF THE INVENTION

1. Field of the Invention

The present invention relates to imaging apparatus (e.g. electrographic apparatus) and more specifically to such apparatus adapted for uniformly developing multi-image sections of web or strip type imaging media which move intermittently during imaging operations.

2. Description of the Prior Art

In electrographic apparatus wherein a plurality of electrostatic images are formed and liquid-developed sequentially along successive portions of a relatively long strip or web material (e.g. in roll-form), a problem is encountered when a break in imaging operations occurs before completion of the entire length of the strip of material. Such mid-strip stopping and restarting can occur, e.g., when a given batch of original documents is completed and more are not ready for recording, or when the operator desires to pause for other reasons. In general, the problem is presented because recorded images should be developed continuously for a period of predetermined duration in order to obtain high quality, and the pause of imaging operations leaves a section of imaged material at a standstill in the development station.

Various techniques have been attempted to obviate the problem. One solution is to cut the strip at its imaged/non-imaged interface when a pause occurs. The entire imaged portion can then be moved through the completion of its development in a continuous pass. The detractive features of this approach are that autothreading structure is required to recommence operations, and splicing is required to reconnect the strip sections for applications wherein its ultimate use is in roll form (e.g. a cassette of microimages).

Another technique that has been attempted in order to accommodate such start-stop development problems is displacing the development means from the strip (or vice versa) when strip-feed stops. In order to obtain complete development of all such displaced strip portions, which are at various positions along the development station when feeding stops, it is necessary, on restarting, to recommence development with those strip portions having their same relative position along the development station. However, a deterioration in image quality has been noted in this mode because a dried or partially dried layer of developer forms on the partially developed strip portions and causes development artifacts, such as fringe development, during subsequent development of those portions. A similar approach is to stop and restart the flow of liquid developer to the development zone in response to the strip-feed's stopping and restarting; however, the same kinds of quality deterioration have been noted with this approach.

SUMMARY OF THE INVENTION

One significant purpose of the present invention is to avoid difficulties of the kind described above and provide apparatus for the improved development of continuous strip sectors that are imaged intermittently. Another advantage of the present invention is the provision of a positively defined feed path that maintains an accurate development gap through the development zone. A related advantage is the elimination of transverse strip curling, which can cause an uneven development gap and, thus, nonuniformity in image development. In another aspect, the present invention provides means for developing different multi-image sections of an imaged strip in predeterminedly different modes, e.g. in positive or reverse development modes, or using different development electrode biases or gaps.

Although the present invention has been found particularly advantageous in electrographic imaging, certain of its features are applicable to other imaging or strip processing systems that encounter similar problems in intermittent modes of operations with long strips. For example, the present invention can be useful in applying solution(s) to photographic strip films or in providing uniform heat development of photothermographic strip materials. Other equivalent applications will occur to those skilled in the art.

In general the present invention provides, in apparatus having an operative path along which imaging material is moved past imaging and developing stations, development means located along the path from a developing zone ingress to a developing station egress; means for moving such material through the developing station from said ingress to said egress; and development control means which: (1) during continuous material movement operation constrains imaging material within said developing zone into developing relation with such development means from said egress to said ingress, (2) upon cessation of material movement, releases successive portions of imaging material in said zone from such developing relation, sequentially from said egress to said ingress and (3) upon recommencement of material movement, re-establishes material constraint to said continuous movement condition sequentially from said ingress to said egress. In a highly preferred embodiment of the present invention, the release and re-establishment of constraining conditions, with respect to such material, occurs at the rate of material movement.

BRIEF DESCRIPTION OF THE DRAWINGS

The subsequent description of preferred embodiments of the invention refers to the attached drawings in which:

FIG. 1 is a schematic illustration of one preferred embodiment of the present invention;

FIG. 2 is a side view of one modification of a portion of the FIG. 1 apparatus; and FIG. 3 is a side view of an alternative embodiment of the present invention.

DETAILED DESCRIPTION OF THE PREFERRED EMBODIMENTS

Referring to FIG. 1, an electrographic apparatus 10 incorporating one preferred embodiment of the present invention is shown. The apparatus comprises a feed reel 11 from which a multi-image strip 13 of photoconductor imaging material is pulled under tension along an operative path by a driven take-up reel 12. During movement along the operative path successive impage portions of the strip 13 are subjected to an over-all primary electrostatic charge, e.g. by corona discharge device 14, and imagewise exposed at exposure station 15 to form a latent electrostatic image. The strip 13 is then pulled through development station 16, where liquid developer is applied to develop the latent electrostatic images thereon, past a drying or fusing station 17 and wound onto take-up reel 12. The specific structures to perform the above-mentioned electrophotographic functions can be selected from various alternative configurations well known in the art. One specifically preferred liquid development apparatus for use in accordance with the present invention is disclosed in U.S. Pat. No. 3,407,786 and comprises a multiple slit applicator head for applying a liquid developer.

Having now briefly described the various general structural aspects of the FIG. 1 apparatus, the specific structure for implementing improved development operations according to the present invention can be described. Referring to the development station 16 it can be seen that a guide member 20, which has an arcuate convex surface conforming to the slightly concave surface of the developer applicator 21, is positioned on the opposite side of the film path from the developer applicator. In its continuous take-up position (solid line), the material-constraining surface of guide member 20 extends generally throughout the development zone, from the upstream boundary, or ingress, of the development zone to the downstream boundary, or egress, of the development zone. Thus the guide member 20 constrains the image material passing the development zone into a predetermined, closely spaced, development relation with the development applicator 21 throughout that zone. Note, it is preferred according to the present invention for the guide member's constraining surface to be slighly curved. This prevents transverse curling of the material which would cause uneven spacing and uneven development.

Now, consider the condition which exists if, after a period of continuous operation in the mode just described but before the complete supply is recorded, the operator effects a cessation in imaging operations. When this occurs, the strip feed from reel 11 ceases. The portion of the strip between the exposure station and the development zone ingress will have undeveloped latent electrostatic images thereon, but these will remain intact until subsequent operation evokes their development, hence they present no problem. However, this is not the case with the portion of the strip extending between the development zone's ingress and egress, because of the latent image development requires a continuous, predetermined period of contact with developer for consistent quality. To provide such equal development periods, in accordance with the present invention, drive control 25 actuates movement of the guide member 20 to its dotted line position in response to a cessation of strip take-up. It is highly preferred in accordance with the present invention that the rate of movement of the strip-constraining surface of guide member 20 be approximately equal to the rate of film take-up during the steady-state, or continuous operation mode. The reason for this will be understood if the sequential effects of such movement of the guide member 20 are considered.

Thus, as guide 20 moves toward the development zone ingress, from left to right in FIG. 1, successive portions of the strip in the development zone are sequentially released from their constraint in developing relation. Due to the tensioning take-up force, which pulls the strip toward reel 12, the released portions move out of developing contact with applicator 21. Note, the sequence of such constraint-release occurs from the egress to the ingress of the development zone. Thus, the strip portion which has had most development (near the egress) is released first and the strip portion which has had the least development (near the ingress) is released last. If the rate of such constraining-release corresponds to the rate of normal movement of the strip through the development zone each strip portion receives the proper development period. Desirably, a vacuum knife 27 is desirably provided near the ingress to the development zone to withdraw any residual developer from the retracted strip. In some applications, to compensate for gravity and back-up angular velocity on the position of the liquid meniscus between the film and the developer, it is desirable to provide a non-uniform angular velocity for the guide member 20.

Upon recommencement of recording operations, film feed and take-up recommences. To avid redevelopment of strip portions which were in the development zone, the guide member 20 is moved back to its solid line position with the advancing film at the film feed and take-up rate. This re-establishes constraint for all newly developed film portions but avoids constraint of previously developed portions into development relation. When reaching the solid line position the guide member 21 stops and steady state conditions pertain until the next cessation of recording.

The film contacting surface of guide member 20 is preferably smooth, e.g. polished metal or Teflon-coated. Alternatively, the guide surface can comprise an endless belt 30 such as shown on guide member 20' in FIG. 2. Belt 30 moves on pulleys 31, 32 to avoid relative movement with respect to the film 13 during changes of the guide member position.

Another alternative embodiment of the present invention is shown in FIG. 3. There a magnetically attractable sheet material 41 is wound on a spool 42 which is movable across the development zone over the applicator 21. In this embodiment magnetic guides 43 are provided at each transverse edge of the development zone so as to attract the sheet 41 into a strip constraining position when it is rolled out over the development zone. As described with respect to FIG. 1, the spool 42 is moved, at the strip feed and take-up rate, to the dotted line position when film feed and take-up ceases. Spool 42 is moved back to the constraining position at the same rate upon recommencement of film feed and take-up.

In applications in which transverse curling of the imaging material (across its width) is not a significant problem, the constraining device need not extend the full length of the development zone. For example, a rod extending across the path and movable like spool 42 of FIG. 3 could be used. In such a structures the development path desirably would be generally flat so that tension of the material and the rod would provide adequate constraint over the entire portion of the development zone upstream from the rod position.

The invention has been described in detail with particular reference to certain preferred embodiments thereof, but it will be understood that variations and modifications can be effected within the spirit and scope of the invention.

What is claimed is:

1. In imaging apparatus of the kind having an operative path, including imaging and development zones, along which successive portions of a strip of imaging material can be moved for forming a succession of images and along which such movement may be continuous or intermittent, an improved development device comprising:

(a) development means, disposed along said path at said development zone from a strip ingress to said development zone to a strip egress from said development zone, for developing images on said material moving therepast along said path;

(b) transport means for moving such material through said development zone; and (c) development control means, movable along said development zone, for: (1) in a first condition, constraining material in said development zone into developing relation with said development means from said ingress to said egress, (2) in response to cessation of material movement, releasing successive portions of material in said zone from said development relation, sequentially from said egress to said ingress and (3) in response to recommencement of material movement, re-establishing constraint of said material to said first condition sequentially from said ingress to said egress.

2. The invention defined in claim 1 wherein the rate of material movement by said transport means and the rate of release and re-establishment of said constraint by said control means are approximately equal.

3. The invention defined in claim 1 wherein said control includes a guide member for guiding the strip into developing relation with said development means which in said first condition is located in a predeterminedly spaced, opposing relation to said development means substantially across said development zone.

4. The invention defined in claims 1, 2 or 3 wherein said transport means comprises strip take-up means located downstream of said egress position for pulling strip material through said development zone.

5. In an electrographic device of the kind adapted to transport successive portions of a length of web material, continuously or intermittently, along an operative path including a development zone having upstream and downstream boundaries, improved development apparatus comprising:

(a) development means, located along said path and extending between said upstream and downstream boundaries of said development zone, for applying electrographic developer to portions of said web material moving therepast;

(b) guide means for guiding web material into developing relation with said development means, said guide means being movable along said operative path between a first position proximate said downstream boundary of said development zone and a second position proximate said upstream boundary of said development zone;

(c) transport means for moving said material along said operative path through said development zone, under tension, at a predetermined feed rate; and (d) means responsive to cessation of web material transport for moving said guide means from said first position to said second position.

6. The invention defined in claim 5 further comprising means responsive to reactuation of said transport means for moving said guide means from said second position to said first position.

* * * * *